US006941101B2

(12) United States Patent
Kato

(10) Patent No.: US 6,941,101 B2
(45) Date of Patent: Sep. 6, 2005

(54) CLEANING MEMBER FOR REMOVING RESIDUAL TONER FROM INTERMEDIATE TRANSFER BELT

(75) Inventor: Atsushi Kato, Haguri-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/628,496

(22) Filed: Jul. 29, 2003

(65) Prior Publication Data

US 2004/0021839 A1 Feb. 5, 2004

(30) Foreign Application Priority Data

Jul. 29, 2002 (JP) ..... 2002-219198

(51) Int. Cl.[7] ..... G03G 15/16
(52) U.S. Cl. ..... 399/297; 399/302; 399/343
(58) Field of Search ..... 399/297, 302, 399/308, 343, 350, 353, 123, 357

(56) References Cited

U.S. PATENT DOCUMENTS

| | | | | |
|---|---|---|---|---|
| 4,931,839 | A | 6/1990 | Tompkins et al. | |
| 5,083,169 | A | 1/1992 | Usui et al. | |
| 5,237,377 | A | 8/1993 | Harada et al. | |
| 5,671,464 | A | 9/1997 | Kubota | |
| 5,678,134 | A | 10/1997 | Miki et al. | |
| 5,729,788 | A | 3/1998 | Hirohashi et al. | |
| 5,907,746 | A | 5/1999 | Kubota | |
| 6,167,215 | A | 12/2000 | Miyashiro et al. | |
| 6,226,489 | B1 | 5/2001 | Eelen et al. | |
| 6,269,228 | B1 | 7/2001 | Kayahara et al. | |
| 6,519,422 | B1 * | 2/2003 | Takeda et al. | 399/12 |
| 6,621,991 | B2 * | 9/2003 | Nakazato et al. | 399/49 |
| 6,721,519 | B2 * | 4/2004 | Brown | 399/71 |
| 6,741,825 | B2 * | 5/2004 | Omata et al. | 399/309 |

FOREIGN PATENT DOCUMENTS

| | | |
|---|---|---|
| JP | A 57-203270 | 12/1982 |
| JP | 04-69676 | 3/1992 |
| JP | 04-261573 | 9/1992 |
| JP | 04-318883 | 11/1992 |
| JP | 06-167912 | 6/1994 |
| JP | A 9-73240 | 3/1997 |
| JP | 11-327313 | 11/1999 |
| JP | A 2000-267458 | 9/2000 |

OTHER PUBLICATIONS

U.S. Appl. No. 10/289,376, filed Nov. 7, 2002, Nishiwaki.

* cited by examiner

*Primary Examiner*—Hoan Tran
(74) *Attorney, Agent, or Firm*—Oliff & Berridge, PLC

(57) ABSTRACT

A color laser printer includes an intermediate transfer belt, a capture roller for capturing residual toner from the intermediate transfer belt, and a removing roller for removing the toner captured by the capture roller. The capture roller moves to contact and separate from the intermediate transfer belt, and rotates while in contact with the removing roller whether in contact with or separated from the intermediate transfer belt.

18 Claims, 4 Drawing Sheets

CLEANING MEMBER FOR REMOVING RESIDUAL TONER FROM INTERMEDIATE TRANSFER BELT

BACKGROUND OF THE INVENTION

1. Field of the Invention

The present invention relates to an image forming device including an intermediate transfer belt.

2. Related Art

A laser printer is one type of image forming device well known in the art for forming images on a recording medium. The laser printer forms images on the recording medium by first irradiating a laser beam on an electrostatic latent image carrying member, such as a photosensitive drum or a photosensitive belt, and subsequently developing this electrostatic latent image into a visible image with a developer, which is a toner formed of fine particles. The toner image is transferred to and fixed on a recording medium, such as a recording paper, to form a prescribed image.

A color laser printer for forming color images is provided with four colors of toner including cyan (C), magenta (M), yellow (Y), and black (BK). The color laser printer includes a single laser device, a single electrostatic latent image carrying member, and an intermediate transfer member, such as a transfer drum or a transfer belt, that contacts the electrostatic latent image carrying member.

A color printer having this construction forms an electrostatic latent image corresponding to each color, one color at a time, on the electrostatic latent image carrying member and develops the latent image into a visible image using toner for the corresponding colors. The visible image is first transferred to the intermediate transfer member, and this temporary transfer is repeated a total of four times for each color until a multicolored toner image including all four colors of toner is formed on the intermediate transfer member. Subsequently, a color image can be formed on a recording medium by transferring the multicolored toner image to the recording medium in a secondary transfer and fixing the toner thereon. Since all of the toner forming the toner image does not always transfer onto the recording medium, this type of printer includes a cleaning device for removing residual toner left on the intermediate transfer member following the secondary transfer operation. In the color laser printer described above, toner is not removed at the stage in which the four toner images are initially transferred to the intermediate transfer member. However, toner remaining on the intermediate transfer member after the toner image on the intermediate transfer member has been transferred to the recording medium in the secondary transfer must be removed. Therefore, the cleaning device is configured to remove only toner remaining on the intermediate transfer member that was not transferred to the recording medium by appropriately switching the cleaning device between a non-cleaning position for not removing toner and a cleaning position for removing toner. In general, the cleaning device is placed in the cleaning position by moving the cleaning device into contact with the intermediate transfer member and in the non-cleaning position by separating the cleaning device from the intermediate transfer member. An example of this type of cleaning device has been disclosed in Japanese unexamined patent application publication No. HEI-9-73240.

However, the cleaning device in conventional laser printers described above is not able to clean all the toner from the intermediate transfer member when the amount of residual toner is large.

For example, occasionally an error or the like occurs after multicolored toner images are transferred initially to the intermediate transfer member and before the multicolored toner image is transferred to the recording medium, causing a stoppage of the device. At this time, a large amount of toner meant to be transferred onto the recording medium remains on the intermediate transfer member. The cleaning device recovers this residual toner during an error-recovery process, but the amount of toner to be recovered in this case is larger than the normal process when cleaning residual toner after the toner image was properly transferred to the recording medium. When the amount of toner exceeds the capacity of the cleaning device to capture toner, the cleaning device suffers a drop in toner-removing efficiency. If toner remains on the surface of the intermediate transfer member after the cleaning process, the toner image formed in the previous printing operation will be superimposed on the toner image formed based on the new image data, generating ghost images and the like and resulting in a decline in image quality.

SUMMARY OF THE INVENTION

In view of the foregoing, it is an object of the present invention to provide an image forming device including a cleaning device that is capable of reliably recovering developer on an intermediate transfer member through a simple construction.

In order to attain the above and other objects, the present invention provides an image forming device including an image carrying member, an intermediate transfer member, a capturing member, and a removing member. The image carrying member carries a visible image formed of a developer. The visible image is transferred from the image carrying member to the intermediate transfer member. The capturing member moves to contact with and separate from the intermediate transfer member. The capturing member in contact with the intermediate transfer member captures a residual developer on the intermediate transfer member. The removing member removes the captured residual developer from the capturing member. The capturing member is rotatable while contacting the removing member whether the capturing member is in contact with the intermediate transfer member or is separated from the intermediate transfer member.

There is also provided an image forming device including an image carrying member, an intermediate transfer member, a removing unit, a driving source, and a drive transfer unit. The image carrying member carries a visible image formed of a developer. The visible image is transferred from the image carrying member to the intermediate transfer member. The removing unit includes a capturing member that captures a residual developer from the intermediate transfer member, a removing member that removes the captured residual developer from the capturing member, and a developer collecting unit that collects the residual developer removed by the removing member. The driving source generates a driving power. The drive transfer unit includes a gear that transfers the driving force from the driving source to the capturing member to rotate the capturing member. The removing unit is pivotable about an axis between a contact position in which the capturing member contacts the intermediate transfer member and a non-contact position in which the capturing member is not in contact with the intermediate transfer member. The axis is aligned with an axis of the gear.

PREFERRED EMBODIMENTS OF THE PRESENT INVENTION

Next, a preferred embodiment in which the present invention is applied to a color laser printer will be described with reference to the drawings. First, the construction and operations of a color laser printer (hereinafter simply referred to as a "printer") 1 will be described with reference to FIG. 1.

Figure 1:
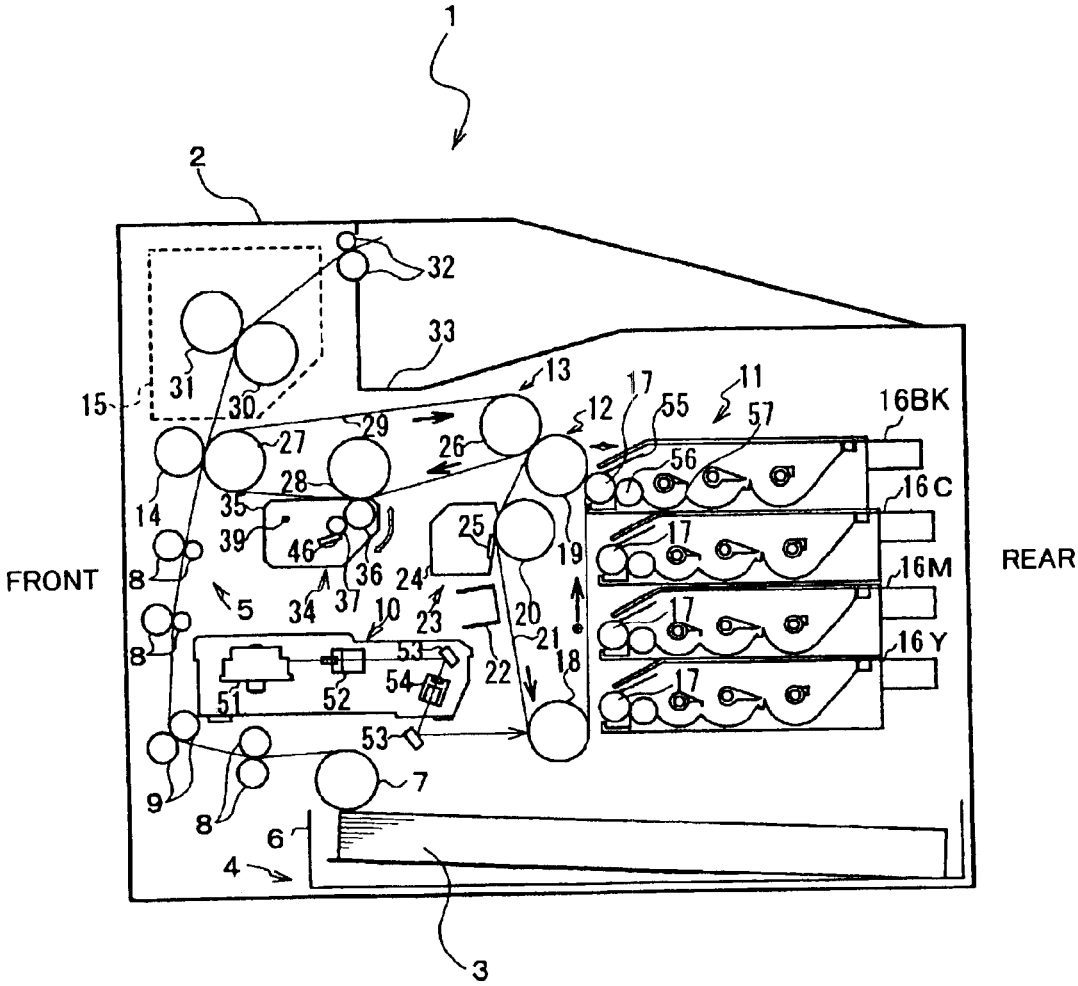
FIG. 1 is a side cross-sectional view showing the relevant parts of a color laser printer according to an embodiment of the present invention.

As shown in FIG. 1, the printer 1 includes a main casing 2 and, within the main casing 2, a feeder unit 4 for feeding sheets of a paper 3, and an image-forming unit 5 for forming prescribed images on the paper 3 supplied from the feeder unit 4.

The feeder unit 4 primarily includes a paper supply tray 6, a feed roller 7, pairs of conveying rollers 8, and a pair of register rollers 9. The paper supply tray 6 accommodates a plurality of sheets of the paper 3 stacked therein. The feed roller 7 pressingly contacts the topmost sheet of the paper 3 in the paper supply tray 6. Through its rotational movement, the feed roller 7 separates the top sheet of the paper 3 one sheet at a time and conveys each sheet toward the conveying rollers 8 and the register rollers 9, and supplies the sheet of the paper 3 to the image-forming unit 5 through a conveying path that is formed vertically in the front section of the main casing 2.

The image-forming unit 5 includes a scanning unit 10, a developing unit 11, a photosensitive belt mechanism 12, an intermediate transfer belt mechanism 13, a transfer roller 14, and a fixing unit 15.

The scanning unit 10 includes a laser light-emitting unit 51 for emitting laser light, a polygon mirror 52 for moving the laser light in a scanning direction orthogonal to the rotational direction of a photosensitive belt 21 described later, a plurality of reflecting mirrors 53 for establishing the path of the laser light, and a lens 54 for focusing the laser light. The laser light emitted from the laser light-emitting unit 51 based on prescribed image data is irradiated on the surface of the photosensitive belt 21 via the polygon mirror 52, the reflecting mirrors 53, the lens 54, and the like to form an electrostatic latent image on the surface of the photosensitive belt 21 at an exposing position.

The developing unit 11 includes four developing cartridges 16Y, 16M, 16C, and 16BK (referred to collectively below as the "developing cartridges 16") for accommodating toner of the colors yellow (Y), magenta (M), cyan (C), and black (BK). These developing cartridges 16 are arranged vertically and parallel to one another in the back section of the main casing 2. The developing cartridges 16 are separated a prescribed distance from each other and arranged in the order given above from bottom to top. The toner used in the present embodiment is a polymerized toner formed of spherical particles that have good fluidity in order to form high quality images.

Each of the developing cartridges 16 includes a developing roller 17, a thickness-regulating blade 55, a supply roller 56, and a toner-accommodating unit 57. The color laser printer 1 further includes a cartridge-driving mechanism (not shown). The cartridge-driving mechanism enables each developing cartridge 16 to move independently in the horizontal direction in order to place the developing roller 17 in contact with the surface of the photosensitive belt 21 or separate the developing roller 17 therefrom.

Toner accommodated in the toner-accommodating unit 57 of each developing cartridge 16 is supplied to the developing roller 17 by the rotation of the supply roller 56. The toner carried on the surface of the developing roller 17 is maintained in a thin layer of uniform thickness by the thickness-regulating blade 55. When the developing roller 17 contacts the surface of the photosensitive belt 21, visible images corresponding to electrostatic latent images formed on the surface of the photosensitive belt 21 are developed by the toner.

The photosensitive belt mechanism 12 includes a first photosensitive belt roller 18, a second photosensitive belt roller 19, a third photosensitive belt roller 20, and the photosensitive belt 21. The photosensitive belt mechanism 12 is disposed on the front side of the developing unit 11 and in confrontation therewith.

Specifically, the first photosensitive belt roller 18 is disposed substantially in opposition to the developing cartridge 16Y in the bottom-most position. The second photosensitive belt roller 19 is disposed vertically above the first photosensitive belt roller 18 and substantially in opposition to the developing cartridge 16BK in the topmost position. The third photosensitive belt roller 20 is disposed diagonally upward from the first photosensitive belt roller 18 toward the front of the main casing 2 and below the second photosensitive belt roller 19 toward the front of the main casing 2.

The photosensitive belt 21 is an endless belt having an organic photosensitive layer formed on the surface thereof. The photosensitive belt 21 is looped around the photosensitive belt rollers 18–20, such that the inner side of the photosensitive belt 21 contacts the photosensitive belt rollers 18, 19, and 20 that form a triangular shape as described above. When a motor, not shown in the drawings, drives the second photosensitive belt roller 19 to rotate, the photosensitive belt 21 runs around the photosensitive belt rollers 18–20 in the counterclockwise direction of FIG. 1.

A photosensitive belt charger 22 is positioned between the third photosensitive belt roller 20 and the first photosensitive belt roller 18 on the front side of the photosensitive belt mechanism 12 and is separated a prescribed distance from the photosensitive belt 21. The photosensitive belt charger 22 generates a corona discharge from a tungsten discharge or the like in order to apply a positive charge uniformly across the surface of the photosensitive belt 21. The photosensitive belt charger 22 charges the surface of the photosensitive belt 21 as a pre-process performed before the surface of the photosensitive belt 21 is exposed to laser light for forming electrostatic latent images. Further, a cleaner 23 is positioned in opposition to the third photosensitive belt roller 20 across the photosensitive belt 21. The cleaner 23 includes a developer-accommodating unit 24 and a removing blade 25 formed of a thin plate. With the cleaner 23 of this construction, the removing blade 25 scrapes residual toner from the surface of the photosensitive belt 21. The toner scraped from this surface is collected and accommodated in the developer-accommodating unit 24.

The intermediate transfer belt mechanism 13 includes a first intermediate transfer belt roller 26, a second intermediate transfer belt roller 27, a third intermediate transfer belt roller 28, and an intermediate transfer belt 29. The intermediate transfer belt mechanism 13 is disposed between the photosensitive belt mechanism 12 and the paper-conveying path in the main casing 2. The first intermediate transfer belt roller 26, which rotates in conjunction with the second photosensitive belt roller 19, drives the intermediate transfer belt 29 to rotate around the intermediate transfer belt rollers 26–28 in the clockwise direction of FIG. 1.

Specifically, the first intermediate transfer belt roller 26 is disposed in confrontation with the second photosensitive belt roller 19 via the photosensitive belt 21 and the intermediate transfer belt 29. The second intermediate transfer belt roller 27 is disposed in front of and slightly below the first intermediate transfer belt roller 26 and opposes the transfer roller 14 via the intermediate transfer belt 29. The third intermediate transfer belt roller 28 is disposed between the first intermediate transfer belt roller 26 and the second intermediate transfer belt roller 27 and slightly below the main casing 2.

Figure 2:
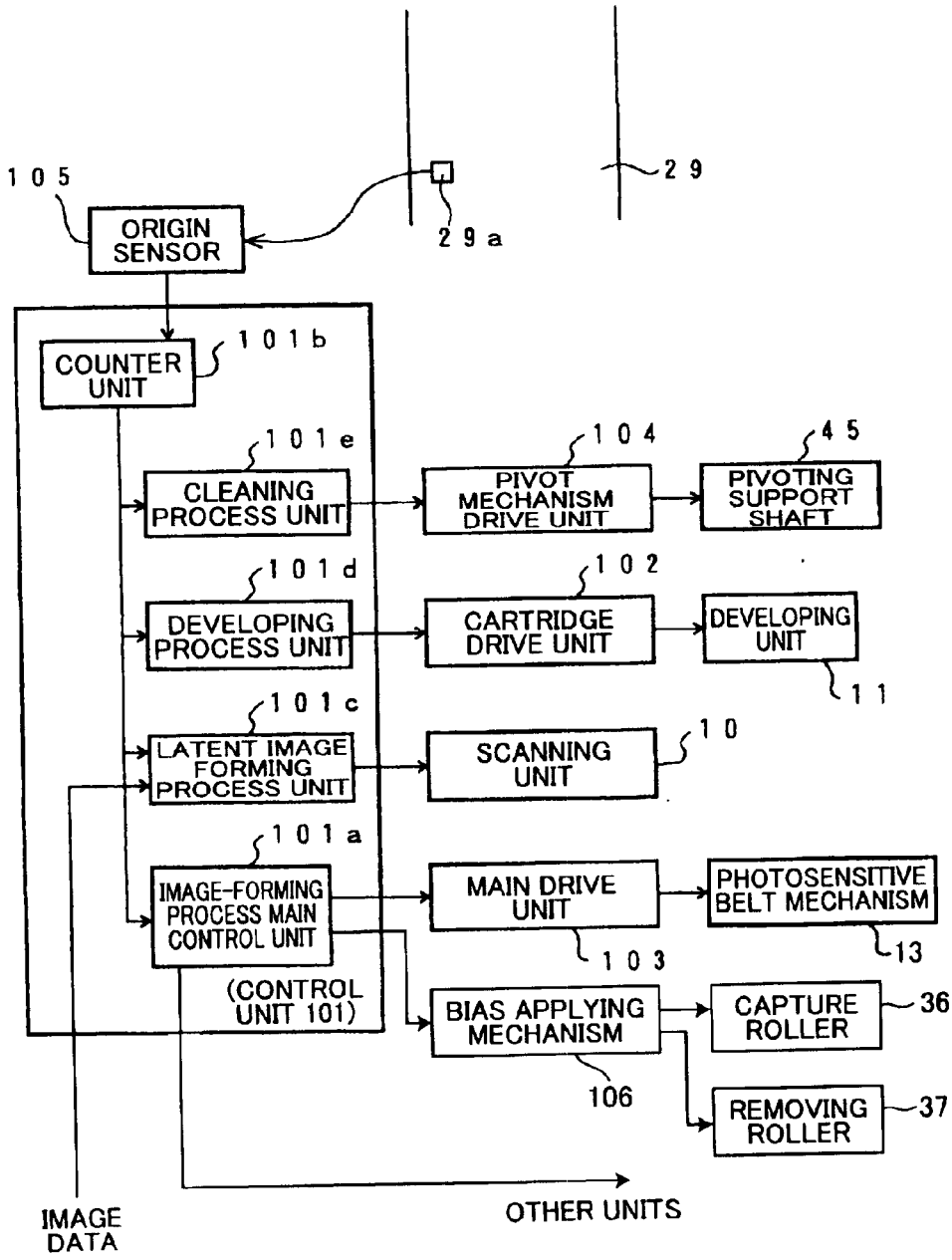
FIG. 2 is a block diagram showing the general electrical configuration of the printer in FIG. 1.

The intermediate transfer belt 29 is an endless belt formed of a resin such as a conductive polycarbonate or a polyimide including dispersed carbon or other conductive particles. The intermediate transfer belt 29 is looped around the intermediate transfer belt rollers 26–28. A prescribed transfer bias is applied to the intermediate transfer belt 29 by a transfer bias applying circuit (not shown). The intermediate transfer belt 29 is configured to contact the photosensitive belt 21 between the first intermediate transfer belt roller 26 and the second photosensitive belt roller 19. The position at which the intermediate transfer belt 29 contacts the photosensitive belt 21 is a primary transfer position. As shown in FIG. 2, a marker 29*a* (a hole in this embodiment) is provided in the intermediate transfer belt 29 to represent a position of origin. The marker 29*a* enables a control unit 101 (FIG. 2) described later to control the rotational operation of the intermediate transfer belt 29.

A developer-removing unit 34 is disposed near the intermediate transfer belt 29 for removing toner from the surface of the intermediate transfer belt 29. The construction of the developer-removing unit 34 is described in more detail below.

The transfer roller 14 is disposed in confrontation with the second intermediate transfer belt roller 27 via the intermediate transfer belt 29. The position at which the transfer roller 14 confronts the intermediate transfer belt 29 is a secondary transfer position. When the paper 3 is conveyed to the secondary transfer position, the transfer roller 14 presses the paper 3 against the intermediate transfer belt 29 while a transfer bias applying circuit (not shown) applies a prescribed transfer bias to the transfer roller 14.

The fixing unit 15 includes a heating roller 30 and a pressure roller 31. The heating roller 30 includes an inner layer of metal covered by an outer layer of silicon rubber. A halogen lamp is provided inside the heating roller 30 for generating heat. The pressure roller 31 contacts the heating roller 30 with pressure.

The fixing unit 15 is disposed slightly above and in front of the intermediate transfer belt mechanism 13. Color images formed on the paper 3 are fixed thereon by heat in the image-forming unit 5 as the paper 3 passes between the heating roller 30 and the pressure roller 31. After passing through the fixing unit 15, the paper 3 is discharged onto a discharge tray 33 by a pair of discharge rollers 32 disposed downstream from the fixing unit 15 in the paper-conveying direction.

Next, the electrical configuration of the color laser printer 1 will be described with reference to FIG. 2. As shown in FIG. 2, the color laser printer 1 includes the control unit 101 mentioned earlier for performing overall control of all components. In addition to a built-in CPU, ROM, RAM, and the like, the control unit 101 includes an image-forming process main control unit 101*a*, a latent image forming process unit 101*c*, a developing process unit 101*d*, a cleaning process unit 101*e*, and a counter unit 101*b*.

The image-forming process main control unit 101*a* initializes settings for all components that are the target of control in the image-forming process and controls each of these components, excluding control processes for operations required to form latent images, develop these images, and clean the intermediate transfer belt. For example, the image-forming process main control unit 101*a* outputs control signals to a main drive unit 103 to drive the photosensitive belt mechanism 13 with a motor (not shown) provided in the main drive unit 103, to rotate the photosensitive belt 21 and the intermediate transfer belt 29 in conjunction with the photosensitive belt 21. The image-forming process main control unit 101*a* also turns ON and OFF the application of a bias to a capture roller 36 and a removing roller 37 (described later) via a bias applying mechanism 106.

The counter unit 101*b* is connected to an origin sensor 105 for detecting the marker 29*a* of the intermediate transfer belt 29. The counter unit 101*b* measures the passage of time from the point at which the marker 29*a* passes a prescribed position based on input signals received from the origin sensor 105. The image-forming process main control unit 101*a* calculates the coordinate position of the intermediate transfer belt 29 using the origin of the intermediate transfer belt 29 as a point of reference based on the passage of time measured by the counter unit 101*b* and controls the timing for driving all mechanisms based on this calculated coordinate position.

The latent image forming process unit 101*c* controls the driving of the scanning unit 10. The developing process unit 101*d* controls a cartridge drive unit 102 for driving the cartridge drive mechanism used to place the developing roller 17 of a specific developing cartridge 16 in contact with the photosensitive belt 21. The cleaning process unit 101*e* will be described later.

With this construction, the image-forming process main control unit 101*a* is activated at the beginning of an image-forming process and begins driving the photosensitive belt 21 and the intermediate transfer belt 29 to rotate. The photosensitive belt charger 22 forms a uniform positive charge on the photosensitive belt 21. At the same time, the counter unit 101*b* is activated and begins to measure the passage of time. Count signals from the counter unit 101*b* are outputted to the image-forming process main control unit 101*a*, the latent image forming process unit 101*c*, the developing process unit 101*d*, and the cleaning process unit 101*e*, enabling the same to perform operations described below at a prescribed timing based on these count signals.

First, the scanning unit 10 irradiates laser light based on color separation data for a multicolored image. The laser light is irradiated on the surface of the positively charged photosensitive belt 21 at the exposing position. By changing the potential on the surface of the photosensitive belt 21 from the state immediately following charging, the laser light forms electrostatic latent images based on the image data. As the photosensitive belt 21 rotates, the electrostatic latent images formed on the surface thereof are conveyed toward the developing unit 11. By outputting a control signal to the cartridge drive unit 102 at a prescribed timing before the electrostatic latent image reaches the developing unit 11, the developing process unit 101*d* drives the cartridge-driving mechanism to move the developing cartridge 16Y in a horizontal direction forward such that the developing roller 17 comes into contact with the photosensitive belt 21. At this time, the developing rollers 17 of the other developing cartridges 16M, 16C, and 16BK are separated from the photosensitive belt 21.

With this construction, a yellow toner image corresponding to the electrostatic latent image is formed on the surface of the photosensitive belt 21 when the electrostatic latent image passes by the developing unit 11. After the image has been completely developed, the cartridge drive unit 102 separates the developing roller 17 from the photosensitive belt 21.

After the developing process, the photosensitive belt 21 continues to rotate, conveying the yellow toner image to the primary transfer position. A bias is applied to the intermediate transfer belt 29 such that the toner image on the photosensitive belt 21 contacting the intermediate transfer belt 29 at the primary transfer position is transferred to the surface of the intermediate transfer belt 29.

Following this primary transfer, the cleaner 23 removes any toner remaining on the photosensitive belt 21, thereby cleaning the surface of the photosensitive belt 21.

Next, the photosensitive belt charger 22 again charges the photosensitive belt 21, after which an electrostatic latent image for magenta is formed on the photosensitive belt 21 at the exposing position. Only the developing roller 17 of the developing cartridge 16M is moved into contact with the photosensitive belt 21 while the developing cartridges 16Y, 16C, and 16BK are separated from the photosensitive belt 21 by the developing cartridge drive mechanism. Accordingly, the electrostatic latent image is developed with magenta toner. Subsequently, the magenta toner image is transferred onto the surface of the intermediate transfer belt 29 through the operations described above and superimposed over the yellow toner image that was transferred earlier.

The operations described above are repeated for the cyan and black colors to ultimately form a multicolored toner image including yellow, magenta, cyan, and black on the surface of the intermediate transfer belt 29.

Subsequently, a sheet of the paper 3 conveyed from the paper supply tray 6 is introduced between the transfer roller 14 and the intermediate transfer belt 29 at the same time the multicolored toner image passes through this secondary transfer position. Accordingly, the multicolored toner image is transferred onto the paper 3, forming a color image on the surface of the paper 3.

After the color image is fixed on the paper 3 in the fixing unit 15, the paper 3 is conveyed to the discharge rollers 32 by the heating roller 30 and the pressure roller 31 and is discharged onto the discharge tray 33 formed on top of the main casing 2 by the discharge rollers 32.

Next, the construction of the developer-removing unit 34 will be described. The developer-removing unit 34 cleans the intermediate transfer belt 29 by removing residual toner from the surface of the intermediate transfer belt 29 following the secondary transfer.

Figure 4:
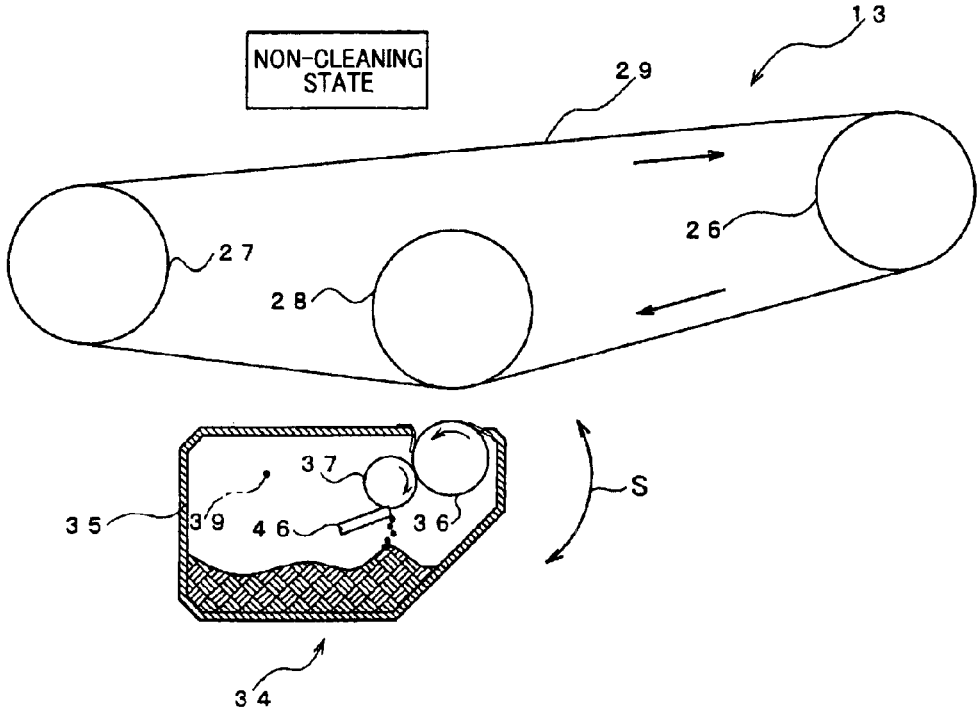
FIG. 4 is an expanded cross-sectional view showing the developer removing unit separated from the intermediate transfer belt in a non-cleaning position.

As shown in FIG. 1, the developer-removing unit 34 is disposed below the intermediate transfer belt mechanism 13 and confronts the third intermediate transfer belt roller 28 via the intermediate transfer belt 29. As shown in FIG. 4, the developer-removing unit 34 includes a developer-accommodating unit 35, the capture roller 36, the removing roller 37, and a removing blade 46.

The developer-accommodating unit 35 is formed in a hollow box shape. An opening is formed in the developer-accommodating unit 35 in the part confronting the intermediate transfer belt 29. A space is formed in the bottom of the developer-accommodating unit 35 as a waste toner receptacle.

The capture roller 36 is rotatably supported in the opening of the developer-accommodating unit 35 such that a portion of the top of the capture roller 36 is exposed therefrom. The capture roller 36 includes a metal roller body covered by a resilient material, such as a conductive rubber. The bias applying mechanism 106 (FIG. 2) applies a prescribed bias in relation to the intermediate transfer belt 29.

The removing roller 37 is formed of a metal roller and rotates in conjunction with the rotations of the capture roller 36 while in contact with the same. The bias applying mechanism 106 applies a prescribed bias to the removing roller 37 in relation to the capture roller 36.

The removing blade 46 is disposed inside the developer-accommodating unit 35 and in contact with the removing roller 37. The removing blade 46 is configured of a thin plate for scraping toner from the surface of the removing roller 37.

Figure 3:
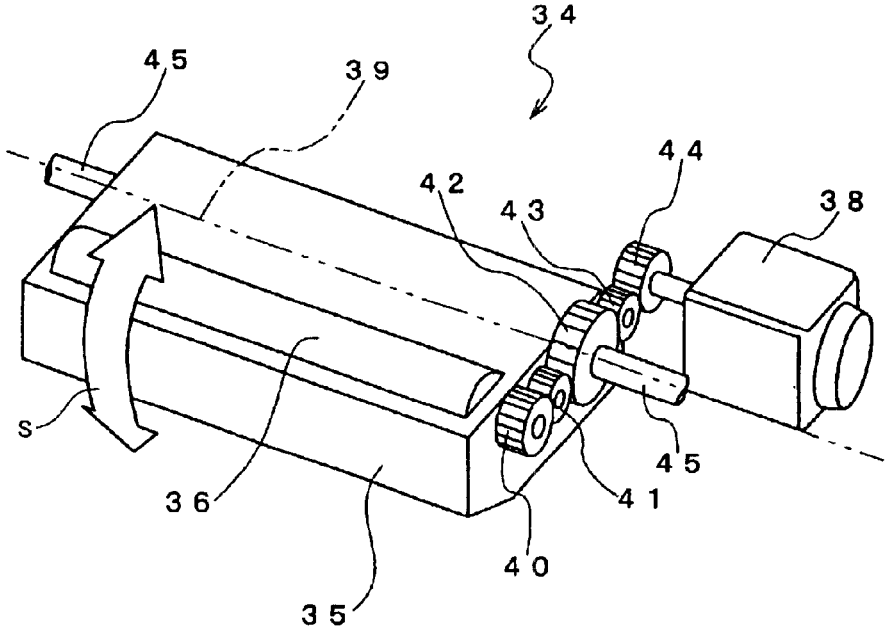
FIG. 3 is a perspective view showing area of the printer in FIG. 1 near the developer removing unit.

A rotating shaft of the capture roller 36 is coupled with a gear 40, as shown in FIG. 3. The gear 40 is linked to a gear 44 on the drive shaft of a motor 38 via a gear train that includes a plurality of gears 41, 42, and 43.

Figure 5:
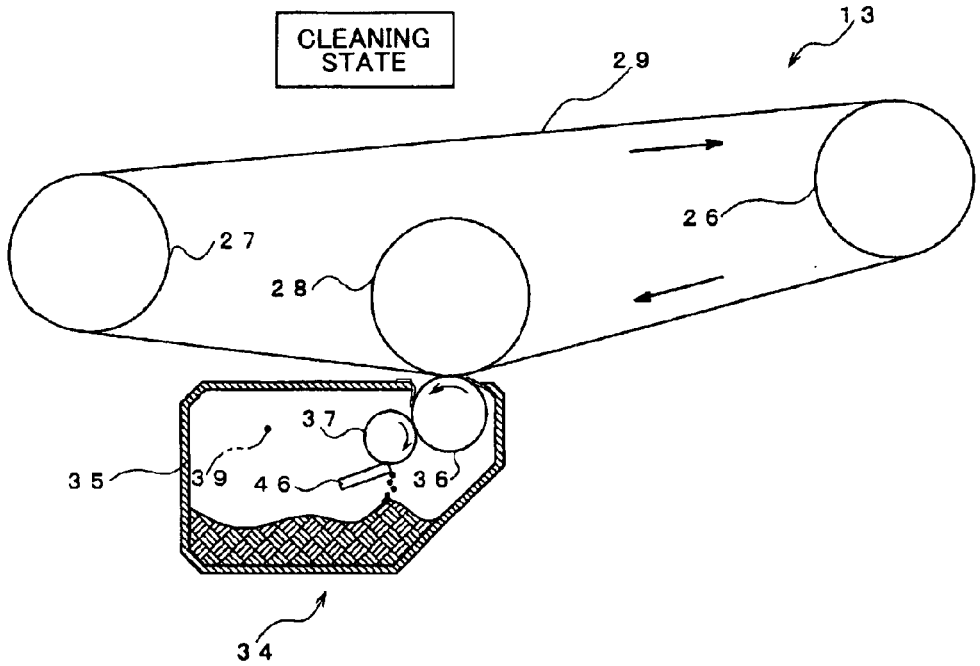
FIG. 5 is an expanded cross-sectional view showing the developer removing unit in contact with the intermediate transfer belt in a cleaning position.

The developer-accommodating unit 35 has a pivoting support shaft 45. The pivoting support shaft 45 has a pivoting axis 39 as shown in FIG. 3. The developer-accommodating unit 35 is supported to be capable of pivoting in the direction of an arrow S about the pivoting axis 39. Accordingly, the developer-removing unit 34 can be switched between a non-cleaning position shown in FIG. 4 and a cleaning position shown in FIG. 5. The gear 42 is supported on the pivoting support shaft 45 and is capable of rotating relative to the same. As shown in FIG. 4, the capture roller 36 is maintained in a state separated from the intermediate transfer belt 29 when the developer-removing unit 34 is in the non-cleaning position. As shown in FIG. 5, the capture roller 36 is maintained in contact with the intermediate transfer belt 29 when the developer-removing unit 34 is in the cleaning position.

Next, the operations of the developer-removing unit 34 and the timing of those operations will be described with reference to FIGS. 4 and 5.

When the cleaning process unit 101*e* shown in FIG. 2 outputs a separation signal to a pivot mechanism drive unit 104, the pivot mechanism drive unit 104 drives the pivoting support shaft 45 to rotate. As a result, the developer-removing unit 34 pivots and the capture roller 36 separates from the intermediate transfer belt 29 as shown in FIG. 4.

On the other hand, when the cleaning process unit 101*e* outputs a contact signal to the pivot mechanism drive unit 104, the pivot mechanism drive unit 104 drives the pivoting support shaft 45 to rotate in the opposite direction from that described above. As a result, the developer-removing unit 34 pivots and the capture roller 36 comes into contact with the intermediate transfer belt 29 as shown in FIG. 5.

Here, the cleaning process unit 101*e* outputs the contact signal and the separation signal at a predetermined timing based on the passage of time measured by the counter unit 101*b*. In the present embodiment, the developer-removing unit 34 is maintained in the non-cleaning position from the primary transfer of the yellow toner image until the primary transfer of the black toner image. After the primary transfer of the black toner image is completed, and after the color image on the intermediate transfer belt 29 is transferred to the paper 3, the developer-removing unit 34 is switched to the cleaning position before the toner remaining on the intermediate transfer belt 29 after the secondary transfer reaches the position at which the capture roller 36 contacts the intermediate transfer belt 29.

While the developer-removing unit 34 is in this cleaning position, the motive force of the motor 38 is transferred to the capture roller 36 via the gears 40–44. The capture roller 36 is driven to rotate in the direction shown in FIG. 5 and the removing roller 37 rotates in conjunction with the capture roller 36. The image-forming process main control unit 101*a* outputs a bias application signal to the bias applying mechanism 106 at the timing in which the developer-removing unit 34 is switched to the cleaning position, and the bias applying mechanism 106 applies a bias to the capture roller 36 in response. As a result, residual toner on the intermediate transfer belt 29 that was not transferred to the paper 3 during the secondary transfer is electrically attracted from the surface of the intermediate transfer belt 29 and captured on the surface of the capture roller 36 by the bias described above. Since the bias applying mechanism 106 also applies a bias to the removing roller 37, toner captured on the capture roller 36 is electrically attracted to the surface of the removing roller 37 by this bias. As the removing roller 37 rotates, toner captured on the surface of the removing roller 37 is brought into contact with the removing blade 46. At this point, the toner is scraped off of the removing roller 37 by the removing blade 46 and falls by its own weight into the developer-accommodating unit 35.

With this construction, the removing roller 37 removes toner from the capture roller 36 at the same time the capture roller 36 in contact with the intermediate transfer belt 29 captures toner therefrom. Therefore, this construction reduces the amount of toner accumulating on the capture roller 36 that can lower the capacity of the capture roller 36 to capture toner.

After the entire toner carrying region of the intermediate transfer belt 29 has passed over the capture roller 36, the developer-removing unit 34 is switched back to the non-cleaning position, separating the capture roller 36 from the intermediate transfer belt 29. At this time, the image-forming process main control unit 101*a* outputs a bias clearing control signal to the bias applying mechanism 106, thereby stopping the bias applying mechanism 106 from applying a bias to the capture roller 36. However, a bias continues to be applied to the removing roller 37. Since the capture roller 36 is still driven to rotate after the developer-removing unit 34 is shifted to the non-cleaning position, and since the removing roller 37 keeps rotating in conjunction with the rotation of the capture roller 36, any residual toner on the surface of the capture roller 36 is electrically captured by the removing roller 37, scraped off of the removing roller 37 by the removing blade 46, and recovered in the developer-accommodating unit 35.

Therefore, the capturing capacity of the capture roller 36 can be restored by removing the toner from the surface of the capture roller 36 before the developer-removing unit 34 is again shifted into the cleaning position, restoring the capture roller 36 to a clean state with no residual toner. Hence, when the capture roller 36 is once again placed into contact with the intermediate transfer belt 29, the capture roller 36 can reliably capture toner from the surface of the intermediate transfer belt 29.

This construction is extremely effective when the amount of residual toner on the surface of the intermediate transfer belt 29 is larger than normal. That is, since the capture roller 36 is shifted into contact with the intermediate transfer belt 29 after the capacity of the capture roller 36 to capture toner has been restored, the capture roller 36 can remove all toner from the intermediate transfer belt 29, even when the amount of residual toner is large, before the toner removing efficiency of the capture roller 36 degrades.

In the preferred embodiment described above, the capture roller 36 is capable of contacting and separating from the intermediate transfer belt 29, and capable of rotating in contact with the removing roller 37 whether the capture roller 36 is in contact with or separated from the intermediate transfer belt 29. Accordingly, toner can be removed from the surface of the capture roller 36 regardless of whether the capture roller 36 and the intermediate transfer belt 29 are in contact with or separated from each other. Hence, with a simple construction, the present invention can prevent the capture roller 36 from becoming saturated with toner. Further, the present invention can improve the efficiency of capturing toner from the intermediate transfer belt 29 and removing toner captured on the capture roller 36, thereby improving the quality of the images formed.

Further, the pivoting axis 39 of the developer-removing unit 34 is aligned with the axis of the gear 42, which forms a part of the gear train 40, 41, 42, 43, and 44 for transferring the motive force from the motor 38 to the capture roller 36. Since the distance between axes of the capture roller 36 and the gear 42 does not change when the developer-removing unit 34 is pivoted, it is possible to maintain the engagement of gears in the gear train that construct the path for transferring motive force from the gear 42 to the capture roller 36. Accordingly, the motive force from the motor 38 is reliably transferred to the capture roller 36 whether the capture roller 36 is in contact with the intermediate transfer belt 29 or separated therefrom, enabling the capture roller 36 to continue rotating.

In the preferred embodiment, a bias is applied to both the capture roller 36 and the removing roller 37 to electrostatically capture toner. It is particularly effective to capture toner in this way when using a polymerized toner.

While some exemplary embodiments of this invention have been described in detail, those skilled in the art will recognize that there are many possible modifications and variations which may be made in these exemplary embodiments while yet retaining many of the novel features and advantages of the invention. For example, a ground toner may be used as the developer instead of a polymerized toner.

Further, rotation of the capture roller 36 in the non-contact state is not limited to times during the primary transfer, but can be performed at various other times when it is desirable to ensure that the capture roller 36 is free of toner. For example, the capture roller 36 can be rotated in the non-contact state when the power to the color laser printer 1 is turned ON, when the color laser printer 1 is undergoing a recovery process from a power-saving mode (sleep mode) in which the color laser printer 1 was idle for a long period of time, when the color laser printer 1 has continuously printed a prescribed number of pages, or any time that there is concern for toner buildup on the capture roller 36. In this way, the present invention can improve the reliability and efficiency of the capture roller 36 for capturing toner in subsequent printing operations.

While the embodiment for the color laser printer 1 has been described in detail, the present invention is not limited to a color laser printer, but can be applied to other image-forming devices, including a monochrome printer, a copying machine, and a facsimile device.

The mechanism for driving the capture roller 36 is not limited to the above configuration. For example, a belt or the like can be used in place of the gear train or any other means for transferring motive force from the driving source.

A brush or other member can be used in place of the removing roller 37, provided that the member can recover toner from the surface of the capture roller 36. Further, the means for capturing toner from the surface of the intermediate transfer belt 29 is not limited to the capture roller 36, but can be any construction capable of capturing toner from the intermediate transfer belt 29.

What is claimed is:

1. An image forming device, comprising:

an image carrying member that carries a visible image formed of a developer;

an intermediate transfer member to which the visible image is transferred from the image carrying member;

a capturing member that moves to contact with and separate from the intermediate transfer member, the capturing member in contact with the intermediate transfer member capturing a residual developer on the intermediate transfer member;

a removing member that removes the captured residual developer from the capturing member; and a controlling unit that controls the capturing member to rotate in a state separated from the intermediate transfer member in at least such cases when the power is turned ON, when recovering from a sleep mode, after printing a prescribed number of sheets, and after performing an initialization operation when recovering from an error, wherein the capturing member is rotatable while contacting the removing member whether the capturing member is in contact with the intermediate transfer member or is separated from the intermediate transfer member.

2. The image forming device according to claim 1, further comprising:

an exposing member that exposes the image carrying member to light based on image data at an exposing position so as to form a latent image on the image carrying member;

a plurality of developing members, each corresponding to a different color and developing the latent image with a developer into a visible image on the image carrying member at a developing position downstream from the exposing position in a first direction;

a primary transfer member that transfers the visible image to the intermediate transfer member at a primary transfer position downstream from the developing position in the first direction; and a secondary transfer member that transfers the visible image from the intermediate transfer member to a recording medium at a secondary transfer position downstream from the primary transfer position in a second direction;

wherein the image carrying member moves in the first direction, while the intermediate transfer member moves in the second direction while in contact with the image carrying member.

3. The image forming device according to claim 1, wherein the capturing member is formed of a conducting material.

4. The image forming device according to claim 1, wherein the removing member has a removing roller that contacts the capturing member.

5. The image forming device according to claim 4, further comprising a blade that contacts the removing roller.

6. The image forming device according to claim 5, wherein the removing roller is formed of a conducting material.

7. The image forming device according to claim 1, wherein the developer is a polymerized toner.

8. The image forming device according to claim 1, wherein the capturing member moves to separate from the intermediate transfer member while keeps rotating.

9. An image forming device comprising:

an image carrying member that carries a visible image formed of a developer;

an intermediate transfer member to which the visible image is transferred from the image carrying member;

a removing unit including a capturing member that captures a residual developer from the intermediate transfer member, a removing member that removes the captured residual developer from the capturing member, and a developer collecting unit that collects the residual developer removed by the removing member;

a driving source that generates a driving power; and a drive transfer unit including a gear that transfers the driving force from the driving source to the capturing member to rotate the capturing member, wherein the removing unit is pivotable about an axis between a contact position in which the capturing member contacts the intermediate transfer member and a non-contact position in which the capturing member is not in contact with the intermediate transfer member, the axis being aligned with an axis of the gear.

10. The image forming device according to claim 9, wherein the capturing member is rotatable while contacting the removing member whether the capturing member is in contact with the intermediate transfer member or is separated from the intermediate transfer member.

11. The image forming device according to claim 9, further comprising:

an exposing member that exposes the image carrying member to light based on image data at an exposing position so as to form a latent image on the image carrying member;

a plurality of developing members, each corresponding to a different color and developing a latent image with a developer into a visible image on the image carrying member at a developing position downstream from the exposing position in a first direction;

a primary transfer member that transfers the visible image to the intermediate transfer member at a primary transfer position downstream from the developing position in the first direction; and a secondary transfer member that transfers the visibly image from the intermediate transfer member to a recording medium at a secondary transfer position downstream from the primary transfer position in a second direction;

wherein the image carrying member moves in the first direction, while the intermediate transfer member moves in the second direction while in contact with the image carrying member.

12. The image forming device according to claim 9, wherein the capturing member is formed of a conducting material.

13. The image forming device according to claim 9, wherein the removing member has a removing roller that contacts the capturing member.

14. The image forming device according to claim 13, further comprising a blade that contacts the removing roller.

15. The image forming device according to claim 14, wherein the removing roller is formed of a conducting material.

16. The image forming device according to claim 9, wherein the developer is a polymerized toner.

17. The image forming device according to claim 9, wherein the capturing member moves to separate from the intermediate transfer member while keeps rotating.

18. The image forming device according to claim 9, further comprising:

a controlling unit that controls the capturing member to rotate in a state separated from the intermediate transfer member in at least such cases as when the power is turned ON, when recovering from a sleep mode, after printing a prescribed number of sheets, and after performing an initialization operation when recovering from an error.

* * * * *